US008524326B2

(12) United States Patent
Redlinger et al.

(10) Patent No.: US 8,524,326 B2
(45) Date of Patent: Sep. 3, 2013

(54) PROCESS FOR THE TREATMENT OF CELLULOSIC MOLDED BODIES

(75) Inventors: Sigrid Redlinger, Lenzing (AT); Werner Richardt, St. Georgen (AT)

(73) Assignee: Lenzing Aktiengesellschaft, Lenzing (AT)

( * ) Notice: Subject to any disclaimer, the term of this patent is extended or adjusted under 35 U.S.C. 154(b) by 0 days.

(21) Appl. No.: 12/863,691

(22) PCT Filed: Jan. 19, 2009

(86) PCT No.: PCT/AT2009/000015

§ 371 (c)(1),
(2), (4) Date: Jul. 20, 2010

(87) PCT Pub. No.: WO2009/092121

PCT Pub. Date: Jul. 30, 2009

(65) Prior Publication Data

US 2010/0297408 A1 Nov. 25, 2010

(30) Foreign Application Priority Data

Jan. 22, 2008 (AT) ..... A 82/2008

(51) Int. Cl.
*B05D 3/10* (2006.01)
*C09D 105/08* (2006.01)
*D06M 13/00* (2006.01)

(52) U.S. Cl.
USPC ..... 427/394; 428/206; 428/533; 8/116.1; 442/153

(58) Field of Classification Search
USPC ..... 8/116.1
See application file for complete search history.

(56) References Cited

U.S. PATENT DOCUMENTS

| | | | | |
|---|---|---|---|---|
| 4,102,738 | A | 7/1978 | Dzurik | 162/117 |
| 4,246,221 | A | 1/1981 | McCorsley, III | 264/203 |
| 4,309,534 | A | 1/1982 | Austin | 536/20 |
| 5,320,903 | A | 6/1994 | Hirukawa et al. | 428/364 |
| 5,622,666 | A | 4/1997 | Struszczyk et al. | 264/191 |
| 5,756,111 | A | 5/1998 | Yoshikawa et al. | 424/402 |
| 5,795,522 | A | 8/1998 | Firgo et al. | 264/187 |
| 5,900,479 | A | 5/1999 | Glasser et al. | 536/20 |

(Continued)

FOREIGN PATENT DOCUMENTS

| | | |
|---|---|---|
| AT | 411 769 B | 5/2004 |
| AT | 8388 U2 | 7/2006 |

(Continued)

OTHER PUBLICATIONS

English translation of Park et al. (KR 2001-0007967-A), translation accessed from K-Pion, the Korean Patent Information Online Network.*

(Continued)

*Primary Examiner* — Harold Pyon
*Assistant Examiner* — Katie L Hammer
(74) *Attorney, Agent, or Firm* — Fitzpatrick, Cella, Harper & Scinto

(57) ABSTRACT

The present invention relates to a process for the treatment of a cellulosic molded body which is characterized in that the molded body is contacted with an alkaline dispersion containing undissolved chitosan particles. The chitosan particles are present in the dispersion preferably in a particle size of from 0.1 to 1500 μm, preferably from 1 to 800 μm.

14 Claims, 1 Drawing Sheet

(56) References Cited

U.S. PATENT DOCUMENTS

| | | | | |
|---|---|---|---|---|
| 6,241,933 | B1 | 6/2001 | Köll et al. | 264/340 |
| 6,656,547 | B2 | 12/2003 | Hammer et al. | 428/34.8 |
| 2001/0023000 | A1 | 9/2001 | Hammer et al. | 428/34.8 |
| 2003/0134120 | A1 | 7/2003 | Kim et al. | 428/375 |
| 2003/0186611 | A1 | 10/2003 | Zikeli et al. | 442/361 |
| 2005/0189675 | A1* | 9/2005 | Redlinger et al. | 264/178 F |
| 2007/0161311 | A1 | 7/2007 | Zikeli et al. | 442/181 |
| 2010/0289177 | A1 | 11/2010 | Redlinger et al. | 264/233 |

FOREIGN PATENT DOCUMENTS

| | | | |
|---|---|---|---|
| DE | 195 44 097 | C1 | 7/1997 |
| DE | 100 07 794 | A1 | 6/2001 |
| DE | 10 2004 049 282 | A1 | 4/2006 |
| EP | 0 777 098 | A2 | 6/1997 |
| EP | 0 883 645 | B1 | 4/2001 |
| FI | 78127 | B | 2/1989 |
| JP | 56112937 | A | 9/1981 |
| JP | 59116418 | A | 7/1984 |
| JP | 10-037018 | A | 2/1998 |
| JP | 2006-057212 | | 3/2006 |
| KR | 960014022 | B1 | 10/1996 |
| KR | 2001007967 | A * | 2/2001 |
| KR | 20020036398 | A | 5/2002 |
| WO | 88/01316 | A1 | 2/1988 |
| WO | 91/00298 | A1 | 1/1991 |
| WO | 91/09163 | A1 | 6/1991 |
| WO | 9319230 | A1 | 9/1993 |
| WO | 97/07266 | A1 | 2/1997 |
| WO | 99/19555 | A1 | 4/1999 |
| WO | 01/32751 | A1 | 5/2001 |
| WO | 03/056081 | A1 | 7/2003 |
| WO | 2004/007818 | A1 | 1/2004 |
| WO | WO 2005/012630 | A2 | 2/2005 |
| WO | 2006/060835 | A1 | 6/2006 |

OTHER PUBLICATIONS

Database WPI Week 200382, Thomson Scientific, London, GB; AN 2003-881274 (XP 002554734).

International Search Report issued in International Application No. PCT/AT2009/000334—4 pages.

Abstract Disseration of Christian Augsten, Germany, 2008.

"Erzeugnisse aus Polysaccharidverbunden" (Taeger, E. et al., TITK—Thuringisches Institut fur Textilund Kunststoff-Forschung, 1997, pp. 1-47, report No. FKZ 95/NR 036F).

* cited by examiner

PROCESS FOR THE TREATMENT OF CELLULOSIC MOLDED BODIES

BACKGROUND OF THE INVENTION

1. Field of the Invention

The invention relates to a process for the treatment of a cellulosic molded body.

In particular, the invention relates to a process for modifying the properties of cellulosic molded bodies using chitosan.

2. Description of Related Art

Chitin and chitosan are natural, biodegradable, non-toxic, non-allergenic, bioactive and biocompatible polymers with a structure similar to that of cellulose. Chitin is obtained from the shells of crustaceans, a waste material of the crab and shrimp industries. The worldwide interest in the possible uses of chitin has seen an enormous increase in recent years as it is regarded as the second largest resource of natural polysaccharides beside cellulose.

Chitosan consists of poly-(1,4)-2-amino-2-desoxy-beta-D-glucose and is produced by deacetylation of chitin (poly-(1,4)-2-acetamide-2-desoxy-beta-D-glucose). For reasons of solubility—chitin is insoluble in water, organic solvents, diluted acids and bases—chitosan, which is soluble in diluted acids, aqueous methanol and glycerol, has the by far greater significance.

Areas of application for chitin and chitosan are the immobilization of cells and enzymes in biotechnology, the treatment of wounds in medicine, the use as nutritional supplement and preserving agent in the food industry, the preservation of seeds in agriculture, and the use as flocculating agent and chelating agent with heavy metals in sewage systems.

However, a modification of chitin/chitosan has to be carried out for most areas of application in order to improve the solubility in aqueous systems.

The use of chitosan in the textile industry is divided into three fields of application:

- the production of 100% chitosan fibers and the production of "man-made fibers" with incorporated chitosan, respectively
- the finishing and coating of textile fibers
- auxiliary process agents for the textile industry Due to their antibacterial properties and inhibitory effects on the growth of pathogenic germs, chitosan fibers are used in the field of medicine, e.g., as wound coverage and surgical sutures. Chitin and chitosan, respectively, can be broken down enzymatically or hydrolytically by endogenic ferments and therefore are reabsorbable. The effect of such natural polymers on the healing of wounds consists in the gradual release of N-acetyl-glucosamine, the mucopolysaccharide organization of the collagen as well as the beneficial effect on the tissue growth during wound healing (EP 0 077 098, U.S. Pat. No. 4,309,534, JP81/112937, JP84/116418 and many more).

The disadvantage of fibers made of 100% chitosan, however, consists in that they exhibit low dry strength (chitosan fibers of Innovative Technology Ltd., Winsford, England: titer 0.25 tex; fiber strength conditioned 9 cN/tex; fiber elongation conditioned 12.4%; chitosan fibers of Korea Chitosan Co. LTD: fiber strength conditioned 15 cN/tex; fiber elongation conditioned 26%), that they are extremely brittle and that the wet strength amounts to merely 30% of the dry strength. Therefore, either chitosan fibers are admixed to other man-made fibers, or chitosan is added to the spinning mass during the manufacturing process of, e.g., viscose fibers.

Viscose fibers with incorporated chitin/chitosan (in the following: "chitosan-incorporated viscose fibers") are commercially available, e.g., under the trade names Crabyon (Omikenshi Co) and Chitopoly (Fuji Spinning Co.). Those fibers are produced, for instance, by dispersing chitosan or acetylated chitosan in powder form with a grain size of below 10 μm in water in an amount of from 0.5 to 2% by weight and by adding it to the viscose dope (U.S. Pat. No. 5,320,903). Thereupon, fibers are produced in accordance with the conventional viscose process or the polynosic process.

Further manufacturing processes for chitosan-incorporated viscose fibers are described in U.S. Pat. No. 5,756,111 (complex pre- and post-dissolution processes at low temperature in order to obtain alkaline chitin-chitosan solutions to be added to the viscose solution), in U.S. Pat. No. 5,622,666 (addition of microcrystalline chitosan and a water- and/or alkali-soluble natural polymer, e.g., sodium alginate, which can form ionic bonds with the chitosan, as a dispersion to the viscose dope) and in PCT/FI90/00292 and FI 78127, respectively (addition of microcrystalline chitosan to the spinning mass).

The chitosan-incorporated viscose fibers exhibit an increased dye affinity, an increased water retention value, fungicidal and odor-reducing properties, and also the low wet strength viscose fibers are known for. Since chitosan prevents the growth of bacteria harmful to the skin and eliminates allergic effects, for instance, fabrics made of Chitopoly are particularly suitable for dermatitis patients.

The drawback of all the methods described consists in that the fibers thus obtained contain very fine chitosan particles, since the chitosan is not soluble in the spinning mass.

The secondary agglomeration of the chitosan in the spinning mass or the inhomogeneous distribution, respectively, results in a deterioration of the spinning properties, spinning of fibers with low titers is extremely difficult. For that reason, it is also difficult to increase the amount of incorporated chitosan, since, in doing so, there would be an immediate loss of textile data or, during spinning, numerous fiber breakages would occur. Furthermore, leakages of chitosan occur in the spinning bath, since chitosan is soluble in acids. For the incorporation of chitosan, additional complex steps are necessary.

Furthermore, in order to ensure the effect of the chitosan in the final product, an amount of at least approximately 10% by weight of chitosan has to be incorporated into the fibers, since only then there will be sufficient chitosan on the fiber surface. That is to say, the chitosan incorporated in the interior of the fibers is inaccessible and thus ineffective.

Subsequently, it also was attempted to incorporate chitosan in solvent-spun cellulose fibers produced in accordance with the amine-oxide process (so-called "lyocell fibers"), in particular, because of the high wet and dry strength of lyocell fibers.

In DE 195 44 097, a process for the production of molded bodies from polysaccharide mixtures is described, wherein cellulose and a second polysaccharide are dissolved in an organic polysaccharide solvent mixable with water (preferably NMMO), which may also contain a second solvent.

Furthermore, in KR-A 9614022, the production of chitin-cellulose fibers, referred to as "chitulose", is described, wherein chitin and cellulose are dissolved in a solvent from the group comprising dimethylimidazoline/LiCl, dichloroacetate/chlorinated hydrocarbon, dimethylacetamide/LiCl, N-methylpyrrolidone/LiCl, and yarns are produced according to the wet spinning process. NMMO is not mentioned in the claims.

In EP-A 0 883 645, among other things, the addition of chitosan to the solution as a modified compound for increasing the elasticity of wraps for foodstuff is claimed. The modifying compounds must be miscible with the cellulose/NMMO/water solution.

KR-A-2002036398 describes the incorporation of chitosan derivatives with quaternary ammonium groups into fibers, which are produced in a complex manner.

In DE-A 100 07 794, the production of polymer compositions is described, comprising a biodegradable polymer and a material consisting of sea weed and/or the shells of sea animals, as well as the production of molded bodies therefrom. The addition of a material made of sea weed, sea animals in powder form, in the form of a powder suspension or in liquid form to the cellulose solution produced according to the lyocell process is also claimed. Furthermore, the material may also be added after or during the shredding of the dry cellulose as well as at any stage of the manufacturing process. Despite the addition of the additive, the fibers exhibit the same textile-mechanical properties as they would without the additive. In the examples, only lyocell fibers that have a brown algae powder incorporated are described, wherein, for the production of the spinning mass, the brown algae powder, NMMO and pulp and a stabilizer are mixed and heated to 94° C.

Furthermore, in the final report "Erzeugnisse aus Polysaccharidverbunden" (Taeger, E.; Kramer, H.; Meister, F.; Vorwerg, W.; Radosta, S; TITK—Thüringisches Institut für Textil-und Kunststoff-Forschung, 1997, pp. 1-47, report no. FKZ 95/NR 036 F) it is described that chitosan is dissolved in diluted organic or inorganic acids and then is precipitated in an aqueous NMMO solution. Thus, a suspension of fine chitosan crystals is obtained in the cellulose solution, which then is spun. According to said document, the chitosan remains in the solution in the form of fine crystals even after the dissolution of the cellulose. That leads to the formation of a microheterogeneous two-phase system in the fiber. The strength of the fiber is low (with 10% chitosan: fiber strength conditioned 19.4 cN/tex; fiber elongation conditioned 11.5%).

In WO 04/007818, it is suggested that a chitosonium polymer (a salt of chitosan with an inorganic or organic acid) soluble in the spinning dope be incorporated into the lyocell fiber by adding it to the dope or to a precursor thereof.

As an alternative to the incorporation, the possibility exists to furnish textile assemblies with chitosan in the course of the manufacture. The application of chitosan onto fibers which have already been produced or onto textile articles containing those fibers is subsequently also referred to as "impregnation". However, a basic problem associated therewith is that the chitosan applied in this manner is not fixed and is washed out relatively quickly, whereby the positive effects are lost.

In order to avoid this problem, the use of chitosan nanoparticles for the production of fibers, yarns, knitted fabrics and textile assemblies is suggested in EP 1 243 688. "Nanochitosans" are understood to be roughly spherical solid bodies which have an average diameter ranging from 10 to 300 nm and, due to the small particle diameter, are incorporated between fibrils. The production of nano-chitosans is effected by spray drying, evaporation technique or expansion of supercritical solutions.

In WO 01/32751, a process for the production of nanoparticulate chitosan for cosmetic and pharmaceutical preparations with particle diameters of from 10 to 1000 nm is described, wherein the pH-value of an aqueous acidic chitosan solution is increased in the presence of a surface modifying agent to such an extent that the chitosan will precipitate. Furthermore, in WO 91/00298, the production of microcrystalline chitosan dispersions and powders with particle diameters of from 0.1 to 50 μm is described, wherein the pH-value of an aqueous acidic chitosan solution is increased to such an extent that the chitosan will precipitate.

WO 97/07266 describes the treatment of a lyocell fiber with an acetous 0.5% chitosan solution.

In WO 2004/007818, in addition to the incorporation of a chitosonium polymer into lyocell fibers, also the treatment of never-dried lyocell fibers with the solution or suspension of a chitosonium polymer is described. It has been shown that said process is suitable only for the treatment of never-dried lyocell fibers.

The term "never-dried" thereby describes the state of a freshly spun fiber which has not yet been subjected to a drying step.

A treatment of fiber types other than lyocell fibers in the never-dried state is not possible by means of the process according to WO 2004/007818.

SUMMARY OF THE INVENTION

It is the object of the present invention to provide a process for the treatment of cellulosic molded bodies which does not exhibit the above-mentioned problems of incorporating chitosan into fibers and which is suitable for different types of cellulosic fibers, in the dried as well as in the never-dried state. The chitosan is to be fixed in particular to the fiber surface of regenerated cellulose fibers (lyocell fibers, modal fibers, viscose fibers, polynosic fibers) preferably during the manufacturing process in such a way that the chitosan will still be present on the final product even after a number of household washings.

Said object is achieved by means of a process for the treatment of a cellulosic molded body which is characterized in that the molded body is contacted with an alkaline dispersion containing undissolved chitosan particles.

Surprisingly, it has been shown that a lasting application of chitosan onto the surface of cellulosic molded bodies is possible when the molded bodies are contacted with an alkaline dispersion containing undissolved chitosan particles. The chitosan particles are present in the dispersion preferably in a particle size of from 0.1 to 1500 μm, particularly preferably from 1 to 800 μm. The pH-value of the dispersion preferably exceeds 7, particularly preferably ranging from 9 to 11.

BRIEF DESCRIPTION OF THE DRAWINGS

For a more complete understanding of the present invention and the advantages thereof, reference is made to the following descriptions, taken in conjunction with the accompanying drawings, in which.

DETAILED DESCRIPTION OF THE INVENTION

Figure 1:
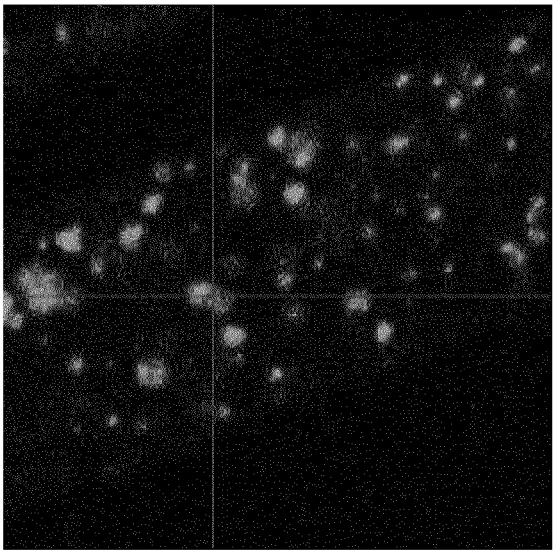
FIG. 1 shows the distribution of chitosan particles on the surface of a lyocell fiber produced according to the invention.

In the literature, there is no uniform definition for the demarcation between chitin and chitosan.

For the purposes of the present invention, the term "chitin" is meant to indicate a β-1,4-bound polymer of 2-acetamido-2-desoxy-D-glucose having a degree of deacetylation of about 0%. Also for the purposes of the present invention, the term "chitosan" indicates an at least partially deacetylated β-1,4-bound polymer of 2-acetamido-2-desoxy-D-glucose.

Compared to known methods for the incorporation of chitosan, the process according to the invention has the advantage that a chitosan incorporated in the interior of the molded body is inaccessible. Only chitosan on the surface of the molded body can come into contact with the skin and thus unfold its positive effect. In order to achieve the same amount of chitosan on the surface of a molded body as with the impregnation, significantly larger amounts of chitosan must therefore be used for the incorporation.

Compared to the use of nano-chitosan, there is in particular an advantage with regard to the high manufacturing costs of nano-chitosan.

Processes according to the invention have the advantage over the process described in WO 2004/007818 that the impregnation with an acidic solution of a chitosonium polymer as described therein does not work during the treatment of never-dried viscose, modal or polynosic fibers with subsequent steaming. In doing so, only extremely small chitosan contents are achieved, and the implementation of said process is impossible without the reconstruction of existing installations.

In addition, the process according to the invention is more cost-saving than the process described in WO 2004/007818, since cheaper chitosan types may preferably be used (see further below).

According to a preferred embodiment of the process according to the invention, the content of chitosan particles in the dispersion ranges from 0.001 to 10% by weight, preferably from 0.1 to 2% by weight.

It has been shown that all commercially available chitosan types which are soluble in an acid (e.g., lactic acid) and, in case of a precipitation with alkali, result in dispersions with chitosan particles having a particle size of from 0.1 to 1500 μm are suitable for the implementation of the process according to the invention. The solubility of a chitosan type in acids essentially depends on the degree of deacetylation of the chitosan. If deacetylation is too little, solubility deteriorates.

Also higher-molecular weight chitosan types (with a viscosity of a 1% solution in 1% acetic acid at 20-25° C. of 200 mPa·s or more, measured with a Brookfield Viscometer at 30 rpm) are particularly suitable for the implementation of the process according to the invention. Higher-molecular weight chitosans are generally lower-priced.

The molded body treated according to the invention is preferably present in the form of fibers. In particular, the fibers may be lyocell fibers, modal fibers, polynosic fibers and/or viscose fibers.

The generic name "lyocell" was allocated by BISFA (The International Bureau for the Standardization of Man Made Fibers) and denotes cellulose fibers produced from solutions of cellulose in an organic solvent. Preferably, tertiary amine oxides, particularly N-methyl-morpholine-N-oxide (NMMO), are used as solvents. A process for the manufacture of lyocell fibers is described, for example, in U.S. Pat. No. 4,246,221.

Viscose fibers are fibers which are obtained from an alkaline solution of cellulose xanthogenate (viscose) by precipitating and regenerating the cellulose.

Modal fibers are cellulose fibers which, according to the definition by BISFA, are characterized by a high wet tensile strength and a high wet modulus (the force which is required for stretching a fiber in the wet state by 5%).

During the treatment with the chitosan dispersion, the fibers may be present in an already dried form, in particular as a component of a textile article, preferably of a yarn, a fabric, a knitted fabric or an article of clothing manufactured therefrom.

"Already dried" fibers are understood to be fibers which have already been subjected to a drying step at least once in the course of the process of their manufacture.

An efficient treatment of already dried cellulose fibers or of textile articles containing them with chitosan in an undissolved form has not been described so far.

Alternatively, the fibers may be present in a never-dried form. In particular, the fibers may be present in the form of a fiber fleece, which appears as an intermediate in the course of the manufacturing process of lyocell, viscose, modal and polynosic staple fibers.

Said variant has the advantage that the treatment can be implemented in an existing installation for the manufacture of lyocell, viscose, modal or polynosic fibers without the need of changes to the equipment. A treatment of never-dried viscose, modal or polynosic fibers with chitosan has not been described so far.

Prior to the treatment, the fibers may have a residual moisture of from 50% to 500%.

After the treatment with the dispersion containing chitosan particles, the molded body may be subjected to a treatment with superheated steam. An additional fixation of the chitosan on the surface of the molded body can thereby be achieved.

For the production of the chitosan dispersion, chitosan is preferably dissolved in an inorganic or organic acid (e.g., lactic acid), and subsequently alkali is added for the precipitation of the chitosan. After complete dissolution of the chitosan, particularly preferably, an aqueous alkali hydroxide solution, e.g., NaOH, is metered in, with the chitosan solution being stirred, in order to increase the pH-value to >7. The final pH-value preferably ranges from 9 to 11.

For a continuous treatment, the chitosan dispersion thus obtained may be contacted, for example, with an initially wet regenerated cellulose fiber fleece which has been adjusted to a defined moisture of from 50% to 500%, e.g., by squeezing. The fleece may be impregnated, for example, by spraying. In installations for the manufacture of viscose fibers and modal fibers, the so-called bleaching zone may, for example, be used therefor without the need of reconstructing existing production plants.

After impregnation, the fleece can be squeezed to a defined moisture of from 50%-500%, and the treatment liquor squeezed out can be returned to the impregnation cycle.

Thereupon, the fleece is either treated with superheated steam and washed neutrally afterwards or is neutrally washed, finished and dried without treatment with superheated steam.

A further preferred variant of the process comprises producing the dispersion in situ by metering an acidic chitosan solution into an alkaline treatment liquid, e.g., a finishing bath, and the molded body is treated at the same time with the treatment liquid and the dispersion formed in situ.

If the acidic chitosan solution is metered, e.g., into a fiber finishing bath having a pH-value>7, the chitosan dispersion is generated in situ and thus the fiber is simultaneously impregnated and finished with chitosan. Subsequently, the fiber can be dried without washing it out.

In a further preferred embodiment, the molded body is subjected to a treatment with a cross-linking agent before or after drying.

Suitable cross-linking agents are described, e.g., in WO 99/19555. Such cross-linking agents are applied to the fiber in an alkaline environment. If, in a typical approach, the fiber is contacted with the cross-linking agent in an alkaline environment, the cross-linking agent is optionally fixed by means of superheated steam and an acidic chitosan solution is subsequently applied to the fiber, in-situ-formation of an alkaline chitosan dispersion occurs also therein due to the alkalinity of the fiber surface.

Thus, according to the invention, the alkaline chitosan dispersion can, in general, also be produced in situ by applying an acidic chitosan solution onto a fiber or fiber surface, respectively, which is alkaline as a result of an alkaline pretreatment.

In addition, the present invention relates to a molded body obtainable by the process according to the invention.

The molded body according to the invention may, in particular, be present in the form of fibers, preferably lyocell fibers, modal fibers, polynosic fibers and/or viscose fibers.

One characteristic of molded bodies obtainable according to the process according to the invention is that the surface of the molded body exhibits chitosan particles distributed in a spot-like manner. In contrast, with molded bodies produced, for example, according to the process according to WO 04/007818, a film-like distribution of chitosan particles on the surface is determinable.

The present invention also relates to the use of a molded body according to the invention as an antibacterial product, as an odor-reducing product, in nonwoven products and/or as a filling fiber. Because of the mildly antibacterial, odor-reducing, skin-friendly properties, preferred areas of application of chitosan-containing regenerated cellulose fibers according to the invention comprise textiles worn close to the body such as, e.g., underwear or socks, textiles for persons with sensitive skin (neurodermatitis), bed linen and household textiles. As a filling fiber, the fiber according to the invention may be used both alone and in mixtures with other fibers such as, e.g., cotton, polyester fibers and unmodified cellulose fibers (e.g., lyocell fibers).

In the following, the invention is illustrated in further detail by the following nonlimiting examples and the drawings.

EXAMPLES

Example 1

Impregnation with a Chitosan Dispersion (0.4% by Weight of Chitosan)

Formula for Chitosan Solutions:

For the production of 500 ml of a 0.4% chitosan solution, 2 g of chitosan is filled up with distilled water to 497.6 g, is mixed with 2.4 g lactic acid (81.2%), is stirred until the chitosan is dissolved completely, and is then adjusted with a 5% NaOH solution to a pH-value of 11.0, while being stirred. An approx. 0.4% chitosan dispersion is formed.

Procedure of Fiber Impregnation:

Never-dried fibers are impregnated with the dispersion at room temperature at a liquor ratio of 1:10 for 5 minutes and are then squeezed at 1 bar. Thereupon, variant a), the fibers are washed out 10 times with tap water and 10 times with distilled water, dried and carded variant b), the fibers are steamed at 100° C./100% relative moisture for 5 minutes, washed out, dried and the sample is carded Fiber Samples Used:

1.3 dtex lyocell fiber washed so as to be free from NMMO, never-dried 1.3 dtex modal fiber unbleached, never-dried 1.3 dtex viscose fiber unbleached, never-dried Commercially Available Chitosan Types that are Used:

Heppe Type 85/200/A1 (which implies a degree of deacetylation of 85 and a viscosity of a 1% solution in 1% acetic acid of 200 mPa·s), chitosan particle size in the dispersion: 90%<675 μm Primex Type Chitoclear fg 95ULV TM 2284, chitosan particle size in the dispersion: 90%<15 μm.

Measuring Methods:

The chitosan particle size in the dispersion is determined by laser diffraction (measuring device: Sympatec/Helos Quixel, wet dispersion system).

The chitosan content on the fiber is determined by measuring the N-content (LECO FP 328 nitrogen analyzer) by burning up the sample.

FITC (fluorescein isothiocyanate) staining of the fibers and a subsequent examination of the fibers using a fluorescence microscope were performed in order to analyze the chitosan distribution on the fiber surface.

In order to check laboratory samples for the permanence of the chitosan content, a treatment with hot water is carried out: boiling of the card sliver of chitosan-impregnated fibers at 80-90° C. in a beaker (liquor ratio 1:20, after 20 minutes at 80-90° C. replacement of the water, another 20 minutes of boiling after reaching the temperature).

The result of the experiments is listed in the following Table 1:

TABLE 1

| | Chitosan content | | | |
|---|---|---|---|---|
| | % chitosan 85/200/A1 | % chitosan TM2284 | % chitosan after treatment with hot water 85/200/A1 | % chitosan after treatment with hot water TM2284 |
| Lyocell variant a) | 1.3 | 0.25 | 1.3 | 0.20 |
| Lyocell variant b) | 1.0 | 0.42 | 1.0 | 0.35 |
| Modal variant a) | 1.1 | 0.32 | 1.1 | 0.17 |
| Modal variant b) | 1.5 | 0.29 | 1.6 | 0.16 |
| Viscose variant a) | 1.2 | 0.31 | 1.1 | 0.23 |
| Viscose variant b) | 1.0 | 0.44 | 1.3 | 0.30 |

Example 2

Impregnation with Chitosan Dispersion (0.2% by Weight of Chitosan)

For the production of 500 ml of a 0.2% chitosan solution, 1 g of chitosan is filled up with distilled water to 498.8 g, is mixed with 1.2 g lactic acid (81.2%), is stirred until the chitosan is dissolved completely, and is then adjusted with 5% NaOH to a pH-value of 10.0, while being stirred. An approx. 0.2% chitosan dispersion is formed.

Procedure of Fiber Impregnation:

The same approach as in Example 1 is taken (variants a) and b)).

Fiber Samples Used:

1.3 dtex lyocell washed so as to be free from NMMO, never-dried

Commercially Available Chitosan Type that is Used:

Heppe Type 85/400/A1 (viscosity of a 1% solution in 1% acetic acid of 400 mPa·s), chitosan particle size in the suspension 90%<305 μm Knitted stockings were manufactured from the fibers, and the permanence of the chitosan content was checked under conditions of high-temperature polyester dyeing ("HAT permanence").

The result of the experiments is listed in the following Table 2:

TABLE 2

| | Chitosan content | | | |
|---|---|---|---|---|
| | % chitosan 85/400/A1 | % chitosan 85/400/A1 after HAT | % chitosan TM2284 | % chitosan TM2284 after HAT |
| Lyocell variant a) | 0.71 | 0.57 | 0.30 | 0.28 |
| Lyocell variant b) | 0.93 | 0.89 | 0.31 | 0.30 |

Example 3

Impregnation in the Finishing Bath

For the production of 500 ml of a 0.2% chitosan solution, 1 g of chitosan is filled up with distilled water to 498.8 g, is mixed with 1.2 g lactic acid (81.2%), is stirred until the chitosan is dissolved completely, and is then adjusted with 5% NaOH to a pH-value of 10.0, while being stirred. An approx. 0.2% chitosan dispersion is formed.

Fiber Samples Used:

1.3 dtex lyocell washed so as to be free from NMMO, never-dried, with a moisture of 100%

1.3 dtex modal unbleached, never-dried, with a moisture of 100%

Commercially available chitosan types that are used:

Heppe Type 85/400/A1, chitosan particle size in the suspension: 90%<305 μm

Primex Type Chitoclear fg 95 ULV TM 2284, chitosan particle size in the suspension: 90%<15 μm A finishing bath with a pH-value of 8 and 15 g/l of active substance was prepared at 60° C. The 0.2% chitosan dispersion was added at a finishing bath to chitosan dispersion ratio of 1:1, resulting in a chitosan concentration in the finishing bath of 0.1%.

Procedure of Fiber Impregnation:

Never-dried fibers are impregnated at 60° C. at a liquor ratio of 1:10 for 5 minutes and are then squeezed at 3 bar and dried.

Knitted stockings were manufactured from the fibers, and the permanence of the chitosan content was checked under conditions of high-temperature polyester dyeing ("HAT permanence").

The result of the experiments is listed in the following Table 3:

TABLE 3

| | Chitosan content | | | |
|---|---|---|---|---|
| | % chitosan 85/400/A1 | % chitosan 85/400/A1 after HAT | % chitosan TM2284 | % chitosan TM2284 after HAT |
| Lyocell | 0.52 | 0.45 | 0.61 | 0.36 |
| Modal | 0.49 | 0.42 | 0.64 | 0.30 |

Example 4

Manufacture of a 6.7 dtex 60 mm Regenerated Cellulose Fiber with Chitosan and Silicone Formula for Chitosan Solutions:

For the production of 500 ml of a 0.6% chitosan solution, 3 g of chitosan is filled up with distilled water to 496.4 g, is mixed with 3.6 g lactic acid (81.2%), is stirred until the chitosan is dissolved completely, and is then adjusted with 5% NaOH to a pH-value of 11.0, while being stirred. An approx 0.6% chitosan dispersion is formed.

Procedure of Fiber Impregnation:

Never-dried fibers are impregnated at room temperature at a liquor ratio of 1:10 for 5 minutes and are then squeezed at 1 bar. Thereupon, this is washed out 10 times with distilled water, and subsequently the fiber is placed for 5 minutes into a silicone bath with an active content of 13 g/l at room temperature at a liquor ratio of 1:12, is squeezed at 1 bar, dried and carded.

Commercially Available Chitosan Types that are Used:

Primex Chitoclear fg 95 ULV TM 2284, chitosan particle size in the suspension: 90%<15 μm Fiber Samples Used:

6.7 dtex lyocell washed so as to be free from NMMO, never-dried 6.7 dtex modal trilobal (according to WO 2006/060835), unbleached, never-dried The fibers were subjected to a household washing in a washing machine (gentle cycle at 60° C., commercially available liquid detergent, dosage according to manufacturer's instruction, fibers are put into laundry bags, washed out again manually upon completion of the household washing, dried). Three washings were performed.

The result of the experiments is listed in the following Table 4:

TABLE 4

| | Chitosan content | |
|---|---|---|
| | % chitosan TM2284 | % chitosan after household washing |
| 6.7 dtex Lyocell | 0.45 | 0.33 |
| 6.7 dtex Modal trilobal | 0.49 | 0.34 |

Example 4

Production Experiments—Manufacture of a 1.7 dtex 38 mm Lyocell Fiber with Chitosan According to the process described in WO 93/19230, fibers of the lyocell type having 1.7 dtex 38 mm were produced in the continuous production process and were impregnated according to the invention in the never-dried state with a dispersion of chitosan, Type TM 2284 (0.2% by weight), which had been precipitated in alkali, at a liquor ratio of 1:20 to a desired content of 0.6% by weight of chitosan, steamed, washed out, finished and dried. Yarns Nm 50 were spun from the fibers thus produced and comprising an obtained chitosan content of 0.5% by weight, and said yarns were processed into a textile assembly (single jersey knitwear) exhibiting a chitosan content of 0.4% by weight. After 10 household washings, the chitosan content still amounted to 0.3% by weight.

FIG. 1 shows a confocal photomicrograph of a fiber produced according to Example 4 and stained with fluorescein isothyocyanate. The spot-like distribution of the chitosan (light points) is clearly visible.

Figure 2:
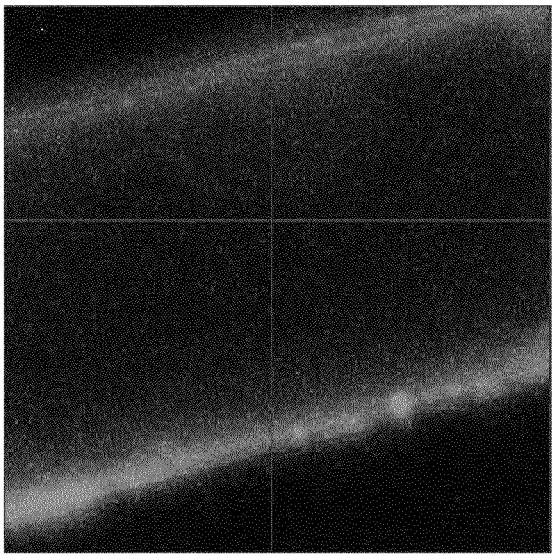
FIG. 2 shows the distribution of chitosan on the surface of a lyocell fiber produced according to the process described in WO 2004/007818 (application of an acidic solution of a chitosonium polymer).

FIG. 2 shows the distribution of chitosan on the surface of a lyocell fiber produced according to the process described in WO 2004/007818 (application of an acidic solution of a chitosonium polymer). The chitosan (light areas) is distributed on the surface in the shape of a film.

What is claimed is:

1. A process for the treatment of a cellulosic molded body which comprises contacting the molded body with an alkaline dispersion comprising undissolved chitosan particles present in the dispersion in a particle size of from 0.1 to 1500 μm, wherein the molded body comprises fibers, wherein the fibers are selected from the group consisting of lyocell fibers, modal fibers, polynosic fibers, viscose fibers and mixtures thereof and wherein the fibers are never-dried prior to the contacting with the dispersion.

2. The process according to claim 1, wherein the particles size is from 1 to 800 μ.

3. The process according to claim 1, wherein a pH-value of the alkaline dispersion exceeds 7.

4. The process according to claim 3, wherein the pH-value is from about 9 to 11.

5. The process according to claim 1, wherein a content of the chitosan particles in the dispersion is from about 0.001 to 10% by weight.

6. The process according to claim 5, wherein the content of the chitosan particles in the dispersion is from about 0.1 to 2% by weight.

7. The process according to claim 1, wherein the chitosan particles in the dispersion are produced from chitosan which has a viscosity of at least 200 mPa.s in a 1% solution in 1% acetic acid at about 20-25° C.

8. The process according to claim 1, wherein the fibers are in a form of a fiber fleece.

9. The process according to claim 1, wherein the fibers have a residual moisture of from about 50% to about 500% prior to the contacting with the dispersion.

10. The process according to claim 1, wherein the molded body is subjected to a treatment with superheated steam after the contacting with the dispersion.

11. The process according to claim 1, wherein the dispersion is produced by dissolving chitosan in an inorganic or organic acid, and subsequently adding alkali to precipitate the chitosan to form the undissolved chitosan particles.

12. The process according to claim 11, wherein the dispersion is produced in situ by metering an acidic chitosan solution into an alkaline treatment liquid and treating the molded body at the same time with the treatment liquid and the dispersion formed in situ.

13. The process according to claim 12, wherein the alkaline treatment liquid is a finishing bath.

14. The process according to claim 11, wherein the dispersion is produced in situ by applying an acidic chitosan solution onto a fiber surface which is alkaline as a result of an alkaline pretreatment.

* * * * *